US006742867B2

(12) United States Patent
Eck et al.

(10) Patent No.: US 6,742,867 B2
(45) Date of Patent: Jun. 1, 2004

(54) PRINTING DEVICE

(75) Inventors: Rainer Eck, Gochsheim (DE); Michael Koblinger, Kolitzheim (DE); Karl Erich Albert Schaschek, Thüngen (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/416,158

(22) PCT Filed: Oct. 15, 2001

(86) PCT No.: PCT/DE01/03944

§ 371 (c)(1),
(2), (4) Date: May 15, 2003

(87) PCT Pub. No.: WO02/40279

PCT Pub. Date: May 23, 2002

(65) Prior Publication Data

US 2004/0037603 A1 Feb. 26, 2004

(30) Foreign Application Priority Data

Nov. 17, 2000 (DE) ..... 100 57 061

(51) Int. Cl.[7] ..... B41J 2/14

(52) U.S. Cl. ..... 347/42; 347/13; 347/40; 347/43; 101/93.04

(58) Field of Search ..... 101/93.04; 347/42, 347/43, 40, 13

(56) References Cited

U.S. PATENT DOCUMENTS 4,593,295 A * 6/1986 Matsufuji et al. ..... 347/41
4,660,052 A * 4/1987 Kaiya et al. ..... 347/200
4,864,328 A 9/1989 Fischbeck
4,922,271 A 5/1990 Nilsson et al.
5,719,602 A 2/1998 Hackleman et al.
5,796,416 A 8/1998 Silverbrook
5,932,348 A * 8/1999 Li ..... 428/402
6,137,506 A 10/2000 Sueoka
6,172,689 B1 * 1/2001 Cunnagin et al. ..... 347/8
6,257,699 B1 * 7/2001 Tracy et al. ..... 347/40
6,293,651 B1 * 9/2001 Sawano ..... 347/40

FOREIGN PATENT DOCUMENTS

| | | |
|---|---|---|
| DE | 37 30 844 A1 | 3/1989 |
| EP | 0 433 556 A2 | 6/1991 |
| WO | WO 97/31781 | 9/1997 |

* cited by examiner

*Primary Examiner*—Edward Lefkowitz
*Assistant Examiner*—Andrea H. Evans
(74) *Attorney, Agent, or Firm*—Jones Tullar & Cooper PC

(57) ABSTRACT

A printing device includes a plurality of print heads, each of which has a printing zone. An extension of this printing zone in a direction of printing defines a line height and an extention of this printing zone perpendicular to the direction of printing defines a column width. The printing heads are arranged in several parallel rows which are located at a distance from one another. The print heads in different rows are offset in relation to each other direction perpendicular to the direction of printing. A separation distance between the print heads in each row corresponds to the column width multiplied by the number of rows. The distance between the rows corresponds to the line height multiplied by the number of rows plus one.

7 Claims, 1 Drawing Sheet

PRINTING DEVICE

Figure 1:
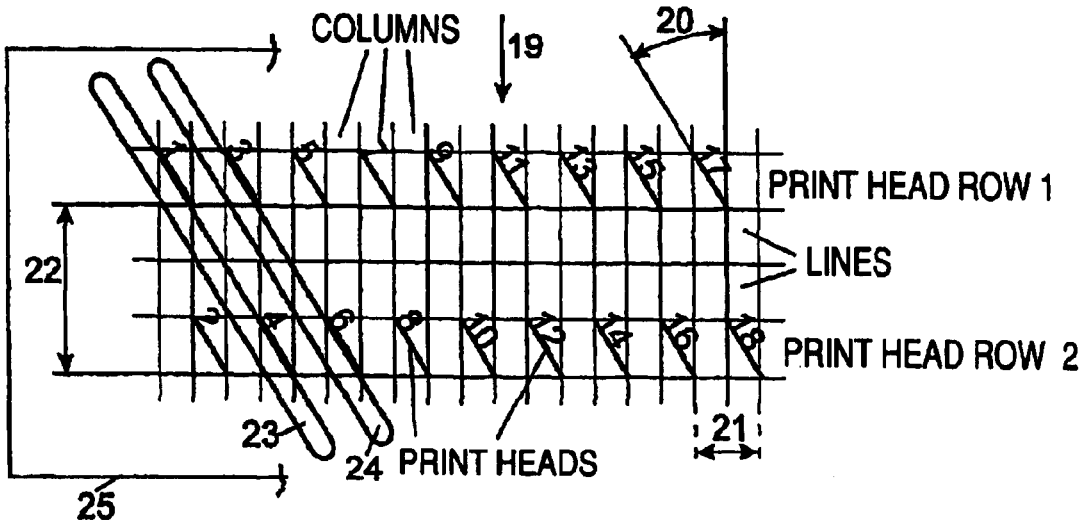

The present invention is directed to a printing device. The printed device has a plurality of print heads, each of which has a printing area.

BACKGROUND OF THE INVENTION

The printing device is provided with a plurality of print heads, each of which has a printing area whose extension, in the printing direction, fixes a line height, and whose extension transversely to the printing direction fixes a column width. The print heads are arranged in several parallel rows that are spaced apart from each other. The print heads of different rows are offset transversely to the printing direction in respect to each other.

The term "print direction" in this context means the movement direction of the material to be imprinted relative to the print heads. If printing plates mounted on rotating printing plate cylinders are provided as the material to be imprinted, the print direction extends perpendicularly in respect to the axis of rotation of the printing plate cylinder.

Printing devices of this general type are employed for placing images on offset printing plates, for example. A coating material, or in the inverse situation, a solvent for dissolving a coating of the printing plate, can be sprayed on the latter by operation of the plurality of print heads.

In order to obtain a printed image of high quality, it is desirable to be able to apply the medium to be applied to the printing plates finely and evenly distributed to each area of the printing plate and without missing any spots. For this purpose, the print heads must be sufficiently closely aligned in relation to each other. On the other hand, the possible density for packing the print heads close to each other is limited, since they touch each other. It would therefore be desirable to make do with as few print heads as possible.

U.S. Pat. No. 5,719,602 shows an ink jet print head with a multitude of nozzle groups. These nozzle groups are arranged offset in respect to each other.

DE 37 30 844 A1 discloses a matrix ink printer. Several print heads, each with several nozzle openings, are arranged offset in relation to each other. In this case, the nozzle openings overlap in relation to the material to be imprinted.

SUMMARY OF THE INVENTION

The object of the present invention is based on providing a printing device.

In accordance with the present invention, this object is attained by the provision of a printing device with a plurality of print heads. Each of these print heads has a printing area. An extension of each printing area in the printing direction fixes a line height. An extension of each printing area transverse to the printing direction fixes a column width. The print heads are arranged in several parallel rows and the print heads in different rows are offset transversely to each other in the printing direction. The spacing of the print heads in each print head row corresponds to the column width times the number of rows. The distance of the rows from each other corresponds to the line height times the number of rows increased by one.

The advantages which can be obtained by the present invention lie, in particular, in that the spacing distance of the print heads in one print head row corresponds to the column width times the number of rows. The distance of the rows from each other corresponds to the line height times the number of rows increased by one. The column jumps in a print head row correspond to the number of print head rows, while the line jumps between adjoining print head rows are greater by one than the number of print head rows in the printing device. The print heads are arranged with such accuracy that no gaps and no overlaps between the print heads, in areas where no printing, or double printing would occur, are provided. Accordingly, a high degree of resolution, with a simultaneous compact construction of the printing device, can be achieved.

In an advantageous manner, the print heads of several rows are arranged in a common plane. Specifically, one print head from one row can lie on a common plane with a corresponding print head in every other row. The assembly of the individual print heads is made considerably easier. They can, in particular, be fastened on a level print head holder. Besides a compact arrangement, it is also possible, in this way, to achieve a simple alignment capability of the print heads in relation to each other.

In accordance with a further development of the present invention, the individual print heads are arranged obliquely with respect to the print direction in order to achieve a higher resolution. Each printing head has a longitudinal direction which is determined by its print area, or by the line along which the nozzle openings are arranged. The print heads are arranged obliquely, in respect to the print direction, in such a way that the longitudinal direction for each print head extends at an acute angle to the print direction. That acute angle can be matched to the existing circumstances, and in particular can be matched to the shape of the print heads. In accordance with an embodiment of the present invention, the angle can lie between 20° and 45°, and in particular can be approximately 30°.

In a further development of the present invention, the print heads from the different rows are placed obliquely by the same angle with respect to the print direction. In particular, they can be arranged in such a way that the longitudinal directions of the print heads of different rows lie on a common plane. The common plane is inclined in relation to the print direction by the same angle by which the print heads are placed obliquely to the print direction.

Preferred embodiments of the present invention are represented in the drawings and will be described in greater detail in what follows.

Figure 2:
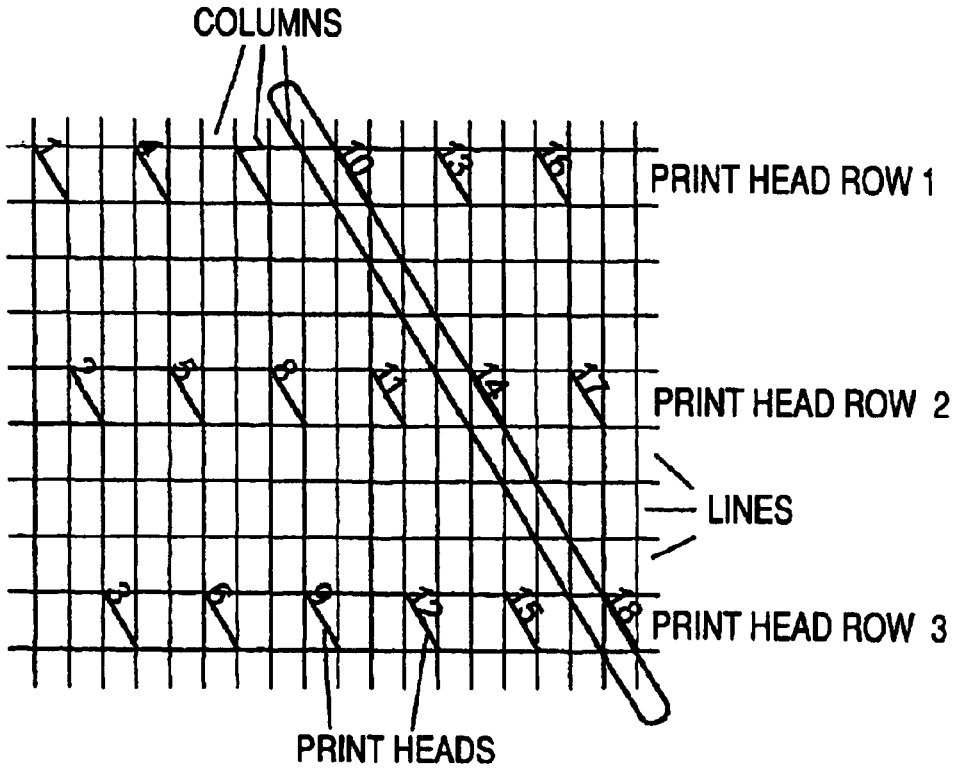

Shown are in:

FIG. 1, a schematic representation of an arrangement of the print heads of a printing device in two rows in accordance with a preferred embodiment of the present invention, and in FIG. 2, a schematic representation of the arrangement of the print heads of a printing device in three rows in accordance with a preferred embodiment of the present invention.

DESCRIPTION OF THE PREFERRED EMBODIMENT

Referring initially to FIG. 1, there may be seen a schematic representation of a printing device in accordance with the present invention. The printing device in accordance with FIG. 1 contains eighteen individual print heads 1 to 18, which individual print heads 1–18 are arranged in two rows of print heads. The two rows of print heads extend spaced apart and parallel with each other. Each row is arranged perpendicularly to to the printing direction, which printing direction is indicated by the arrow 19, as seen in FIG. 1.

All of the individual print heads 1 to 18 are placed obliquely, at an angle of inclination 20 in respect to the printing direction 19, in order to achieve greater resolution. Because of the oblique placement of the print heads 1 to 18 it is possible to arrange the print heads 1 to 18 more closely together in respect to each other. The distance of the nozzle openings of the individual print heads 1 to 8 from each other transversely in relation to the printing direction 19 can be reduced. As FIG. 1 shows, the angle of inclination 20 is defined by the printing direction 19, and by the longitudinal direction of each print head 1 to 18. The longitudinal direction of each of the print heads 1 to 18 is defined by a line along which the nozzle openings of each one of the print heads 1 to 18 are arranged. Because of the oblique placement of each of the print heads, a line defined by the nozzle row of each print head 1 to 18 is provided having an extension in the printing direction 19, as well as an extension transversely to the printing direction 19. The line extension of the nozzle row of each print head 1–18 transversely to the printing direction 19 determines the column width of a print head 1 to 18, while the line extension of the row of nozzles in the printing direction 19 defines the line height of the corresponding print head 1 to 18.

The prinit heads 1 to 18 of each row of print heads are spaced apart from each other printing direction 19, as seen in FIGS. 1 and 2. In this case, the print head spacing distance 21 of adjacent ones of the print heads 1 to 18 in one print head row corresponds to the column width times the number of print head rows. In the embodiment of the present invention represented in FIG. 1, the spacing distance between adjacent print heads in each row corresponds to the width of two columns.

Spacing distance 21=column width×number of print head rows

The individual rows of print heads are also spaced apart from adjacent rows of print heads in the printing direction 19. The row spacing distance 22 meets the following conditions:

Row spacing distance 22=line height×(number of print head rows+1)

Thus, with two rows of print heads, as shown in the embodiment of the present invention represented in FIG. 1, the row spacing distance 22 corresponds to three times the line height which, as mentioned, is defined by the extension of the nozzle row of a print head 1 to 18 in the printing direction 19.

In accordance with the selected arrangement of the print heads 1 to 18, each print head 1, 2, 3, 4, 5, 6, 7, 8, 9, 10, 11, 12, 13, 14, 15, 16, 17, 18 which print head is respectively the next one transversely in respect to the printing direction 19, is always located in the next row and is not arranged in the same print head row. As the numbering of the print heads 1 to 18, as depicted in FIGS. 1 and 2 shows, a first print head 1 is arranged in the first print head row, while the subsequent print head 2 is arranged in the second print head row.

With this arrangement of the print heads it is possible to advantageously provide that several print heads 1 to 18 are arranged on a common plane, so that they can be mounted on a level holder. As FIG. 1 shows, the print heads 1 and 4, the print heads 3 and 6, etc., are located on a common plane and are each mounted on a common print head holder 23, or 24, respectively.

This common plane of the nozzle openings of the print heads 1 and 4, 3 and 6, etc. is inclined at the angle of inclination 20 with respect to the printing direction 19 and extends perpendicularly to the printing plane, i.e. to the material to be imprinted. In the case of a rotating material to be imprinted, for example a printing forme of a rotating cylinder of a printing press, the plane is inclined with respect to the axis of rotation of the cylinder and lies in the radial direction of the cylinder.

In principle, it is possible to fasten, or to arrange, the print heads 1 to 18 mounted on a print head holder 23, 24 on different sides of the print head holder. However, a simple and therefore a preferred arrangement is provided in that the print heads 1 and 4 mounted on a print head holder 23 are arranged on the same side of the print head holder 23, as represented in FIG. 1.

The print head holders 23, 24 can be seated on a common support 25, which is depicted schematically in FIG. 1.

The number of print head rows is preferably selected in accordance with space requirements. In accordance with FIG. 2, the print heads 1 to 18 can be arranged in three print head rows. In other respects, the arrangement of the print heads 1 to 18 in FIG. 2 corresponds to the arrangement in accordance with FIG. 1. In particular, the column jumps between the print heads 1 to 18 of a print head row, as well as the line jumps, i.e. the distance between print head rows in the printing direction 19, correspond to the previously discussed and set forth relationship. In the same way, the oblique placement of the individual print heads 1 to 18 corresponds to the above mentioned connections. It is therefore believed appropriate to omit a further explanation of the arrangement in accordance with FIG. 2.

The printing device in accordance with the present invention has the capability for changing the coating, for applying an additional coating, or for changing the properties of a coating on a printing plate and, in particular on a planographic printing plate of a printing press.

While preferred embodiment of a printing device in accordance with the present invention have been set forth fully and completely hereinabove, it will be apparent to one of skill in the art that changes in, for example the specific structure of the print heads, their securement on the support and the like can be made without departing from the true spirit and scope of the present invention which is accordingly to be limited only by the following claims.

What is claimed is:

1. A printing device comprising:

a plurality of print heads, each said print head defining a printing area;

a number of parallel rows of said print heads, said rows being spaced apart from each other in a print direction at a row spacing distance, ones of said print heads in each said row being spaced apart at a print head spacing distance and being offset from the ones of said print heads in other ones of said number of rows in a direction transverse to the print direction;

a line height fixed by an extension of said printing area in the print direction; and a column width fixed by an extension of said printing area in a direction transverse to the print direction, said print head spacing distance corresponding to said column width times said number of rows, said row spacing distance corresponding to said line height times said number of rows increased by one.

2. The printing device of claim 1 wherein at least one print head from each of said number of rows of print heads lie in a common plane.

3. The printing device of claim 1 wherein each said print head has a plurality of nozzle openings, said nozzle openings in each said print head defining a longitudinal direction of each said print head, each said longitudinal direction being arranged obliquely to the printing direction.

4. The printing device of claim 3 wherein said longitudinal directions for print heads from different ones of said number of rows lie in a common plane.

5. The printing device of claim 1 further including print head holders, at least one print head from each of said number of rows being supported by one of said print head holders, each of said print head holders having at least one level surface.

6. The printing device of claim 1 further including a printing forme and wherein said printing device is adapted to apply one of a coating and a coating change means to said printing forme.

7. The printing device of claim 6 wherein said printing forme is a planographic plate.

* * * * *